US006189626B1

(12) United States Patent
Hanseder

(10) Patent No.: US 6,189,626 B1
(45) Date of Patent: Feb. 20, 2001

(54) METHOD AND APPARATUS FOR ACCURATELY POSITIONING A TOOL ON A MOBILE MACHINE USING ON-BOARD POSITIONING SYSTEM AND OFF-BOARD ADJUSTABLE LASER REFERENCE

(75) Inventor: Anthony Hanseder, Santa Clara, CA (US)

(73) Assignee: Trimble Navigation Ltd., Sunnyvale, CA (US)

( * ) Notice: Under 35 U.S.C. 154(b), the term of this patent shall be extended for 0 days.

(21) Appl. No.: 09/218,537

(22) Filed: Dec. 21, 1998

(51) Int. Cl.[7] ..... G06F 165/00
(52) U.S. Cl. ..... 172/4.5; 701/50
(58) Field of Search ..... 172/4.5, 2; 701/50

(56) References Cited

U.S. PATENT DOCUMENTS

| | | |
|---|---|---|
| 5,453,738 | 9/1995 | Zirkl et al. . |
| 5,471,391 | 11/1995 | Gudat et al. . |
| 5,551,518 | 9/1996 | Stratton . |
| 5,600,436 | 2/1997 | Gudat . |
| 5,612,864 | 3/1997 | Henderson . |
| 5,640,323 | 6/1997 | Kleimenhagen et al. . |

FOREIGN PATENT DOCUMENTS

0811727A1 12/1997 (EP) .

*Primary Examiner*—Christopher J. Novosad
(74) *Attorney, Agent, or Firm*—Blakely, Sokoloff, Taylor & Zafman, LLP

(57) ABSTRACT

A method and apparatus for accurately positioning a tool on a mobile machine are provided. The machine operates within a work area about which one or more stationary laser-based subsystems are positioned. The machine includes an on-board subsystem, which comprises a processor, a satellite positioning system (SPS) receiver, a stored digital terrain model (DTM), and a photosensor for detecting a laser beam. The laser beam provides a reference level that is used to adjust the position of the tool. The on-board subsystem determines the current position of the machine using the SPS receiver and accesses the DTM to determine a design elevation corresponding to the current location of the machine. Based on the design elevation, the on-board subsystem computes a height command and transmits the height command to at least one of the laser-based subsystems. Each stationary subsystem includes a vertically telescoping mast on which a laser is mounted, a servo mechanism for raising or lowering the mast, and a receiver for receiving a height command from the on-board subsystem in the machine. The stationary subsystem raises or lowers the mast to adjust the elevation of the laser beam according to the height command.

69 Claims, 10 Drawing Sheets

METHOD AND APPARATUS FOR ACCURATELY POSITIONING A TOOL ON A MOBILE MACHINE USING ON-BOARD POSITIONING SYSTEM AND OFF-BOARD ADJUSTABLE LASER REFERENCE

FIELD OF THE INVENTION

The present invention pertains to the field of guidance and control systems for mobile machines. More particularly, the present invention relates to techniques for accurately positioning a tool on a mobile machine.

BACKGROUND OF THE INVENTION

Various technologies have been developed to accurately position a tool on a mobile machine. These technologies are useful in applications such as construction, mining, and other industries, in which it may be necessary to maintain very tight tolerances. On a construction site, for example, it may be necessary to add or remove earth from a given location to accurately provide a specified design elevation, which may be different from the initial surface elevation. A machine such as an excavator, grader, or bulldozer equipped with a bucket, blade, or other appropriate tool is typically used. Accurate positioning of the tool is critical for achieving the required accuracy.

Some machine control systems rely upon a stationary rotating laser or a robotic total station to assist in accurately positioning the tool. However, such systems are limited to operation with only one machine at a time. In addition, laser based systems tend to be limited by line of sight. Thus, obstructions in the work area, such as other machines, may impair operation of the system. Further, many such systems are effective only when used on very level terrain. Hence, what is needed is a system for accurately positioning a tool on a mobile machine, which overcomes these and other disadvantages of the prior art.

SUMMARY OF THE INVENTION

The present invention includes a method and apparatus for enabling accurate positioning of a tool on a mobile unit operating within an area. Data representing a specified coordinate for various locations in the area are stored, and the current location of the mobile unit is determined. A command is then generated based on the current location of the mobile unit and the data. The command is transmitted from the mobile unit to a stationary device. The stationary device generates a beam and responds to the command by adjusting the beam. The beam is then detected at the mobile unit, and an adjustment of the tool is determined at the mobile unit by using the beam as a reference.

Another aspect of the present invention is a method and apparatus for enabling accurate positioning of a tool on a mobile unit, according to which a laser beam is generated to define a reference coordinate for use in positioning the tool. In particular embodiments, the reference coordinate may be an elevation. In the method, first data indicating the current location of the machine is received, and second data representing specified coordinates for a plurality of locations within the work area is maintained. The second data is accessed to determine a specified coordinate corresponding to the current location of the machine, and a coordinate of the laser beam is adjusted based on the specified coordinate to adjust the reference coordinate.

Yet another aspect of the present invention is a method and apparatus for enabling accurate positioning of a tool in a mobile unit, according to which an on-board subsystem in the mobile unit is operated in both a guidance only mode and an automatic mode. Operation in the guidance only mode includes operating the on-board subsystem to automatically compute a first adjustment of the tool, and outputting an indication of the first adjustment to an operator to guide the operator in manually positioning the tool. Operation in the automatic mode includes operating the on-board subsystem to automatically compute a second adjustment of the tool, and then automatically positioning the tool based on the second adjustment. In particular embodiments, the on-board subsystem is automatically switchable between the two modes in response to the occurrence of a predefined condition.

Still another aspect of the present invention is a method and apparatus for enabling an operator of a mobile machine operating in a work area to accurately position a tool of the machine, according to which design coordinates for a plurality of locations within the work area are stored, and the current location of the machine is determined. A desired adjustment of the tool is then automatically computed, based on the current location of the machine and the design coordinates. An indication of the computed desired adjustment is then displayed to an operator of the tool.

Other features of the present invention will be apparent from the accompanying drawings and from the detailed description which follows.

BRIEF DESCRIPTION OF THE DRAWINGS

The present invention is illustrated by way of example and not limitation in the figures of the accompanying drawings, in which like references indicate similar elements and in which.

DETAILED DESCRIPTION

A method and apparatus for accurately positioning a tool on a mobile machine are described. Briefy, the mobile machine operates within a work area about which one or more stationary laser-based subsystems are positioned. An on-board subsystem in the machine includes a processor, a satellite positioning system (SPS) receiver, a stored digital terrain model (DTM), and a photosensor for detecting a laser beam. The laser beam provides a reference level that is used to adjust the position of the tool. The onboard subsystem determines the current position of the machine using the SPS receiver and accesses the DTM to determine a design elevation corresponding to the current position. Based on the design elevation, the on-board subsystem computes a height command and transmits the height command to at least one of the laser-based stationary subsystems. Each stationary subsystem includes a laser generating a reference laser beam, a mechanism for adjusting the height of the laser beam relative to a horizontal plane, and a receiver for receiving a height command from an on-board subsystem in a mobile machine. The stationary subsystem adjusts the height of the laser according to the height command.

As will be apparent from this description, this approach provides several advantages. First, it is not necessarily limited to use with a single machine. Any machine which has such an on-board system can make use of a stationary subsystem to accurately position a tool. Also, embodiments which employ more than one of the stationary subsystems allow effective operation even when obstructions are present in the work area. Other advantages will be apparent from the description which follows.

Figure 1:
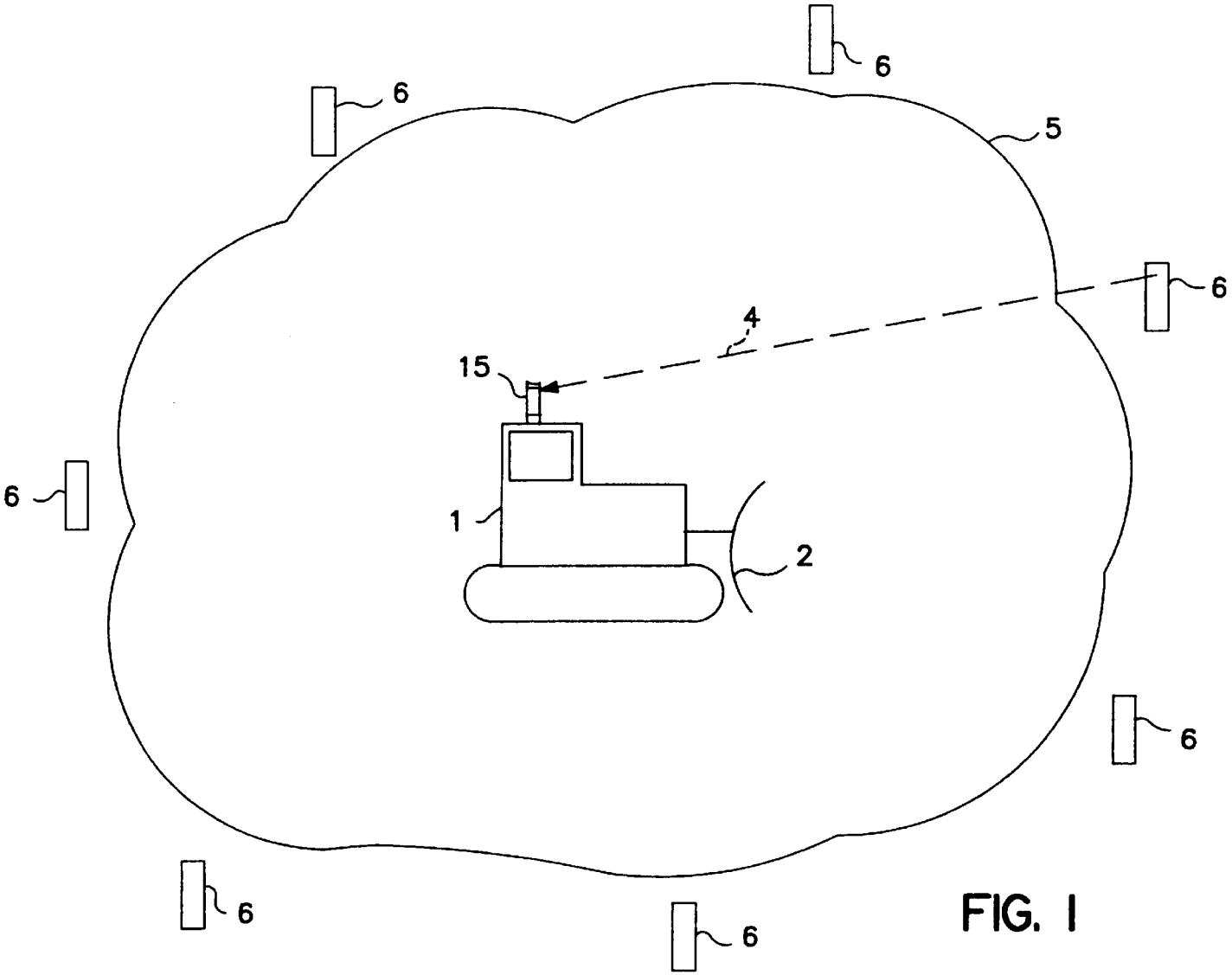
FIG. 1 illustrates an environment including a number of stationary laser-based subsystems positioned about a mobile machine operating in a work area.

Refer now to FIG. 1, which illustrates a mobile machine 1 operating within a work area 5. The mobile machine 1 may be, for example, an excavator, a grader, or a bulldozer. A number of laser-based stationary subsystems 6 are positioned about the work area 5. Each stationary subsystem 6 is capable of generating a laser beam 4, which can be detected by a photosensor 15 on-board the machine 1, for purposes of accurately positioning a tool 2 on the machine 1. The tool 2 may be, for example, a shovel, bucket, blade, or other tool commonly found on such machines. Although FIG. 1 shows multiple stationary subsystems 6, in a first embodiment, the machine 1 makes use of only a single stationary subsystem 6. In a second embodiment, multiple stationary subsystems 6 are employed. In either case, however, the precise elevation of the reference plane is detected by the photosensor 15 on the machine 1 for purposes of adjusting the position of the tool 2.

Figure 2A:
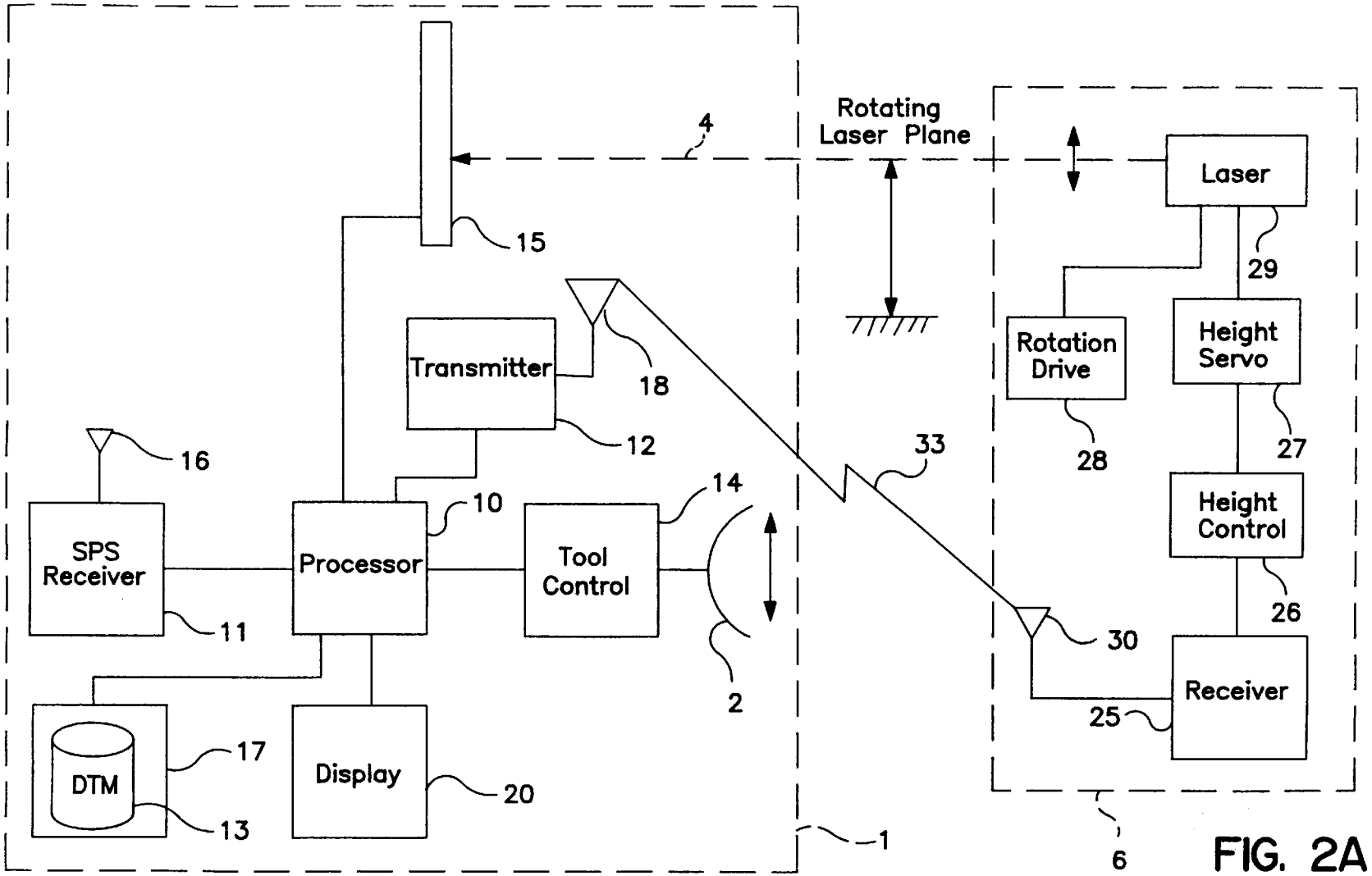
FIG. 2A is a block diagram showing an on-board subsystem in the mobile machine and a stationary subsystem according to an embodiment which uses a rotating laser beam.

FIG. 2A illustrates the on-board subsystem in the machine 1 and a stationary subsystem 6, according to the first embodiment. As shown, the on-board subsystem includes a processor 10, which controls the overall operation of the on-board subsystem. The processor 10 may be or may include any device suitable for controlling and coordinating the operations of the on-board subsystem described herein, such as an appropriately programmed general or special purpose microprocessor, digital signal processor (DSP), microcontroller, an application specific integrated circuit (ASIC) or the like. Coupled to the processor 10 are: a satellite positioning system (SPS) receiver 11, which is coupled to a suitable antennae 16; a storage device 17 storing a digital terrain model (DTM) 13 of the work area 5; a tool control system 14, which is coupled to the tool 2 for controlling movement of the tool; a photosensor 15 for detecting the laser beam; and, a transmitter 12 for transmitting commands and/or data to the stationary subsystem 6 via a transmission antenna 18.

The DTM 13 includes specified design elevations (z coordinates) for multiple (x,y) locations within the work area 5. The SPS receiver 11 may be, for example, a conventional Global Positioning System (GPS) receiver such as commercially available from, for example, Trimble Navigation Limited of Sunnyvale, Calif. In other embodiments, a receiver based on another high accuracy satellite positioning system, such as the global navigation system (GLONASS) established by the former Soviet Union, may be used. In still other embodiments, the SPS receiver 11 and antenna 16 may be replaced with elements of essentially any other high accuracy positioning system, which may not necessarily be satellite based. Such positioning system may be based on pseudolites, for example, or may be an inertial navigation system (INS).

The tool control system 14 may be a standard control system for controlling movement of a tool on a mobile machine, such as currently available on the market. Tool control system 14 may include appropriate actuators and/or servo mechanisms for providing movement of the tool, as well as an appropriately programmed general or special purpose microprocessor, DSP, microcontroller, ASIC, or the like. Storage device 17 may be any device suitable for storing a volume of data sufficient to embody a DTM, such as any form of mass storage device (e.g., magnetic or optical disk), random access memory (RAM), read only memory (ROM), flash memory, or a combination of such devices. Note that the on-board subsystem may also include one or more additional memory devices (not shown) of the types just mentioned for storing program instructions for processor 10 and/or other data. Display device 20 may be a cathode ray tube (CRT), liquid crystal display (LCD), or the like, or a more simple type of display, such as one or more light emitting diodes (LEDs), light bulbs, etc.

Figure 2B:
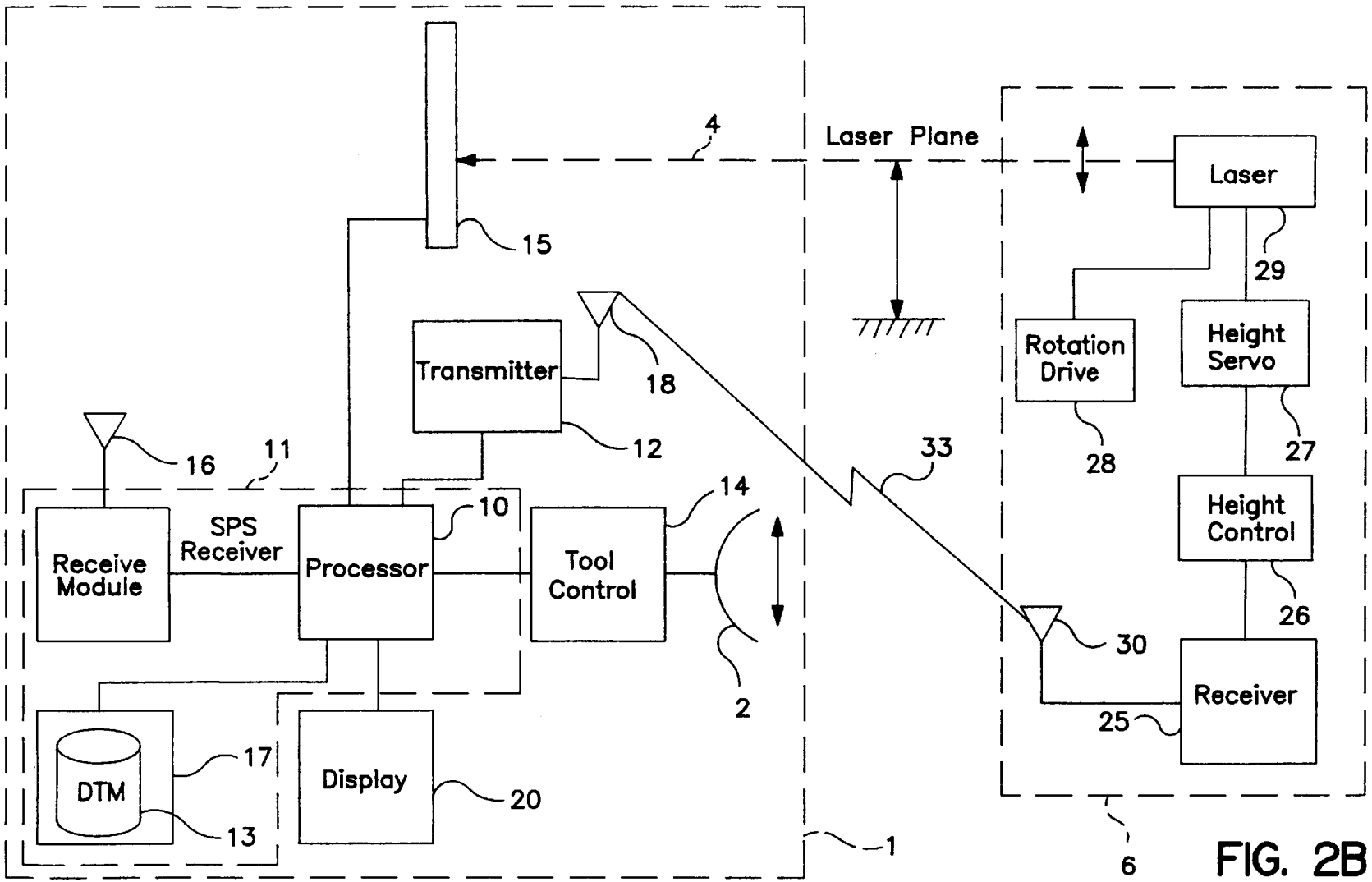
FIG. 2B is a block diagram showing an on-board subsystem in the mobile machine according to an embodiment in which the processor and digital terrain model (DTM) are components of the Satellite Positioning System (SPS) receiver.

In certain embodiments, the SPS receiver 11 may be equipped to store the DTM 13 and/or to perform some or all of the functions of processor 10, which are described further below. Such an embodiment is illustrated in FIG. 2B. Hence, the DTM 13 and the processor 10 may be components of the SPS receiver 11, as shown. Such embodiments may therefore reduce the amount of hardware required in the on-board subsystem, and therefore reduce the size and complexity of the system. The SPS receiver 11 in such an embodiment may be, for example, a GPS receiver, as indicated above.

As shown in FIGS. 2A and 2B, the stationary subsystem 6 includes a laser 29 for generating the laser beam 4, a rotation drive 28 for rotating the laser 29, a height controller 26 coupled to the receiver 25, a height servo mechanism coupled to the height controller 26 and the laser 29, and, an antenna 30, and suitable for receiving commands and/or data from the on-board subsystem of the machine 1. The rotation drive 28 rotates the laser 29 about a vertical axis to cause the rotated laser beam 4 to define a horizontal reference plane. The laser 29 is mounted on a vertically telescoping mast or other suitable mechanism for enabling the height of the laser beam to be adjusted relative to a fixed reference level. The height is adjusted in this embodiment by the servo mechanism 27 based upon a height command transmitted by the on-board subsystem and received by receiver 25. In particular, when received, the height command is used by the height controller 26 to signal the height servo mechanism 27 to adjust the vertical position of the rotating laser beam by an amount indicated by the height command.

Figure 5A:
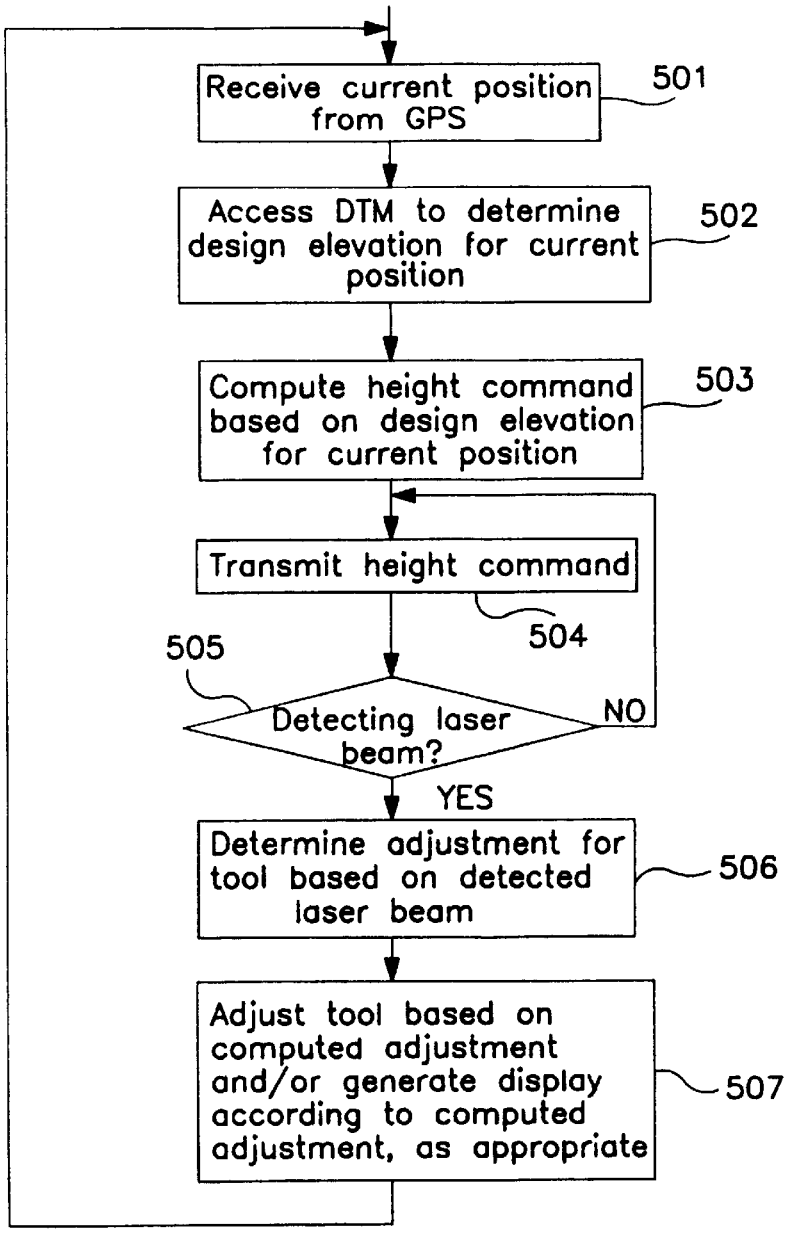
FIG. 5A is a flow diagram illustrating a routine performed in the on-board subsystem of FIG. 2.
Figure 5B:
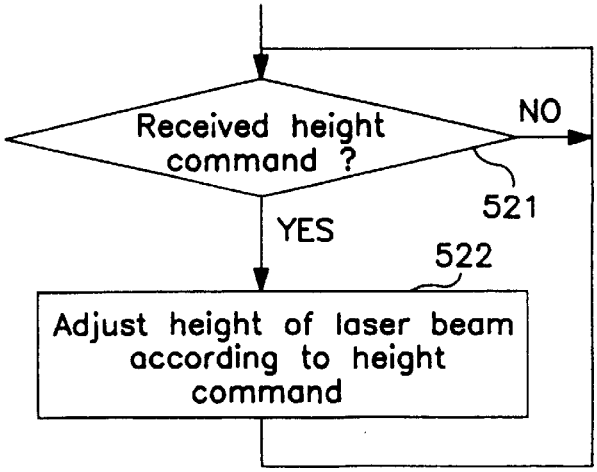
FIG. 5B is a flow diagram illustrating a routine performed in a stationary subsystem in conjunction with the routine of FIG. 5A.

Referring now to FIGS. 5A and 5B, the operation of the first embodiment will now be described. FIG. 5A shows a routine performed in the on-board subsystem, while FIG. 5B shows a corresponding routine performed within the stationary subsystem 6. As the mobile machine 1 moves about the work area 5, the on-board subsystem uses the SPS receiver 11 to determine the current (x,y,z) position coordinates of the machine 1 at block 501. At block 502, the processor uses the current position coordinates to access the DTM 13 to determine the design elevation (z coordinate) for the current (x,y) position of the machine. The processor 10 then computes a height command based upon the difference between the design elevation and the actual elevation of the machine 1 at block 503. To provide high accuracy, computation of the height command is also based on knowledge of the precise location at which the SPS antenna 16 is mounted on the machine 1 and knowledge of the precise manner in which the tool 2 is mounted to the machine 1. Such knowledge is maintained by the on-board subsystem in any suitable form. Once the height command is computed, at block 504 the processor 10 causes the height command to be transmitted by transmitter 12 via antenna 18 over a wireless communication link 33 to the subsystem 6 (see FIG. 2). Link 33 may be, for example, a radio frequency (RF) link. In other embodiments, link 33 may be an optical (e.g., infrared, laser, etc.) link or any other link suitable for communicating commands and/or data between a mobile machine and a stationary subsystem.

Referring now to FIG. 5B, if the height command is received by the stationary subsystem 6 at block 521, then at block 522 the height control unit 26 causes the servo mechanism 27 to adjust the height of the laser beam 4 relative to some reference level based on the height command. Referring again to FIG. 5A, upon detection at block 505 of the rotating laser beam 4 by photosensor 15, which is sensitive to the vertical coordinate of the laser beam 4, processor 10 computes the required adjustment amount for tool 2 at block 506. If the laser beam is not detected, the routine repeats from block 504 with retransmission of the height command or an appropriate error recovery routine.

Following determination of the adjustment amount, at block 507 the processor 10 may signal the tool control system 14 to adjust the position of the tool 2 according to the computed adjustment amount, such that the position of the tool 2 is automatically adjusted by the on-board subsystem. Alternatively, block 507 may simply entail causing the display 20 to indicate the required adjustment to the operator of the machine 1. In particular, it may be desirable in some cases for the on-board subsystem to automatically position the tool 2 according to the computed adjustment amount. In other cases, however, it may be desirable to allow the operator of the machine 1 to adjust the tool, with guidance from the on-board subsystem. Such guidance can be provided in the form of a visual, audible, or other suitable indication of the adjustment amount, as will be discussed below. Accordingly, block 507 may entail merely generating a visual display or other indication according to the computed adjustment amount, rather than automatically adjusting the tool. Note that in the guidance only mode, the on-board subsystem does not necessarily have to detect the laser beam. The indication provided to the operator may be based entirely upon the SPS based elevation and the DTM 13.

Figure 5C:
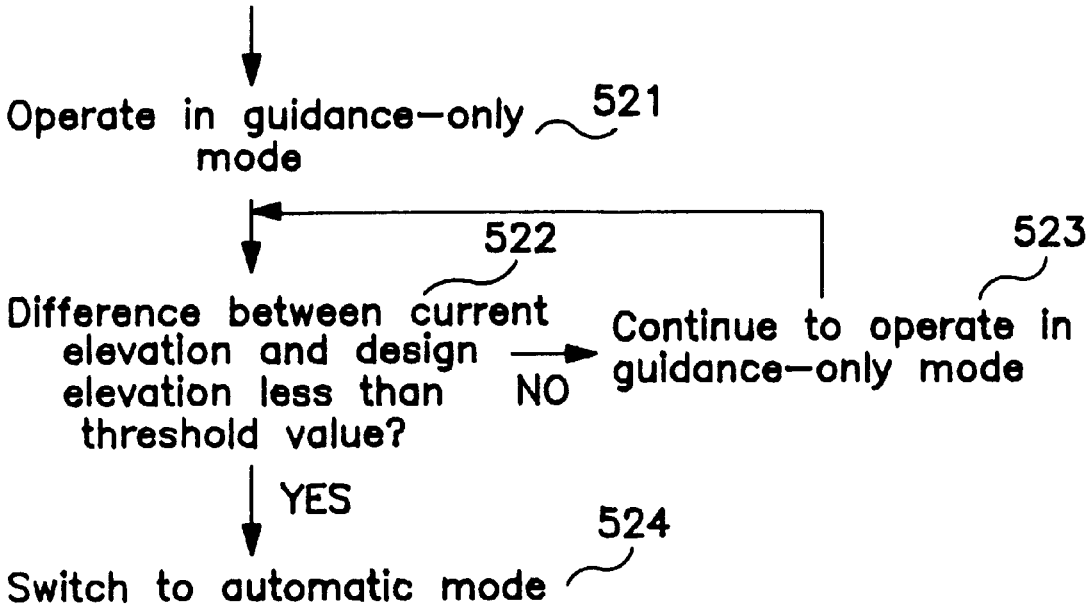
FIG. 5C is a flow diagram illustrating a routine that may be performed in the on-board subsystem to switch between a guidance only mode and an automatic mode.

In some embodiments, it may be desirable to provide both an automatic mode, in which the on-board subsystem automatically adjusts the position of the tool, and a guidance only mode, in which the on-board subsystem merely provides the aforementioned indication to the operator. FIG. 5C shows a routine illustrating how such capability may be applied. Specifically, the on-board subsystem may be operated in guidance only mode at block 521 for purposes of performing rough (approximate) cutting operations. Upon sensing the difference between the current elevation and the design elevation drop below a predetermined threshold value at block 522, the onboard subsystem automatically switches to automatic mode at block 524. The on-board subsystem then is operated in the automatic mode to control fine (precise) operation of the tool 2.

Figure 9A:
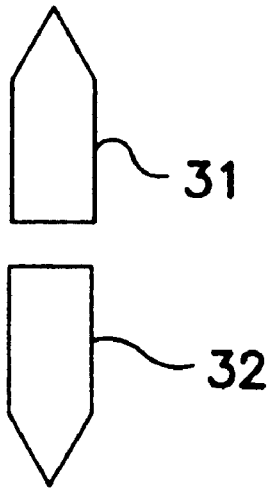
FIGS. 9A and 9B show two embodiments of a visual indicator for guiding an operator of the machine in manually positioning the tool.
Figure 9B:
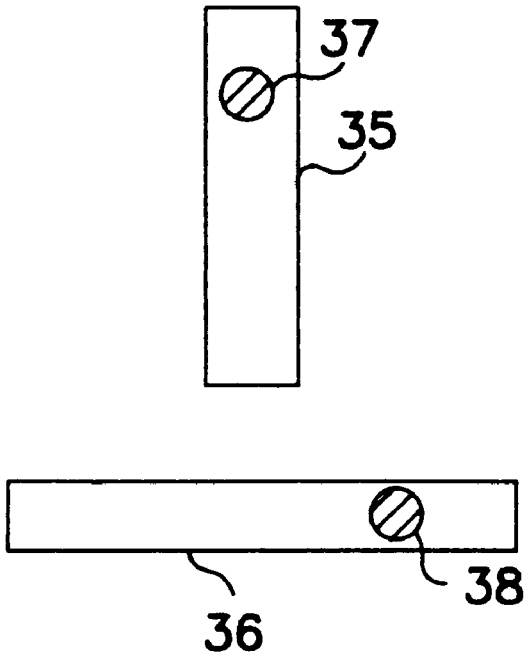

FIGS. 9A and 9B show simple examples of visual indicators that may be used for this purpose. Such visual indicators may be embodied as the display device 20 (FIGS. 2A and 2B) or as graphical representations output by the display device 20. FIG. 9A shows a visual indicator including segments 31 and 32, which light up appropriately to indicate that the operator should adjust the tool up or down, respectively. FIG. 9B illustrates a visual indicator for an embodiment which allows two-dimensional positioning of the tool. The indicator of FIG. 9B includes a vertical indicator 35 and a horizontal indicator 36 containing movable beads 37 and 38, respectively, to indicate to the operator how much to adjust the tool up/down or left/right, respectively.

As noted above, certain embodiments of the present invention may employ multiple stationary laser-based subsystems 6 positioned abut the work area 5, as shown in FIG. 1, rather than only one stationary subsystem. Multiple stationary subsystems may be advantageous, for example, when a machine 1 goes out of the line of sight of a given stationary subsystem. The on-board subsystem can be configured to automatically select an alternate stationary subsystem in such cases. The use of multiple stationary subsystems also allows multiple machines to simultaneously use the techniques described herein, as described further below.

When multiple stationary subsystems are used, it may be desirable to use scanning lasers (i.e., lasers capable of automatically aiming and locking onto a target) rather than rotating lasers. Scanning lasers are well-known, commercially available products. An embodiment which employs multiple stationary subsystems equipped with scanning lasers will now be described. In this embodiment, the DTM 13 includes the exact (x,y) location of each of the stationary subsystems 6, in addition to specified design elevations for the work area 5. Further, each stationary subsystem 6 is assigned a unique identifier. The identifiers of the stationary subsystems are stored in the onboard subsystem of the machine 1 in any suitable format. For example, identifiers similar to Ethernet addresses may be used. Each identifier may be embodied in a simple message header for a data stream broadcast over link 33.

In operation, the on-board subsystem, knowing the exact location of the machine 1 and each stationary subsystem 6, broadcasts a message including the identifier of the closest stationary subsystem and the current position of the machine. The message is ignored by all stationary subsystems except the one whose identifier was transmitted. The identified subsystem uses the position coordinates of the machine to aim the scanning laser to lock onto the photosensor 15 of the machine 15.

Figure 3:
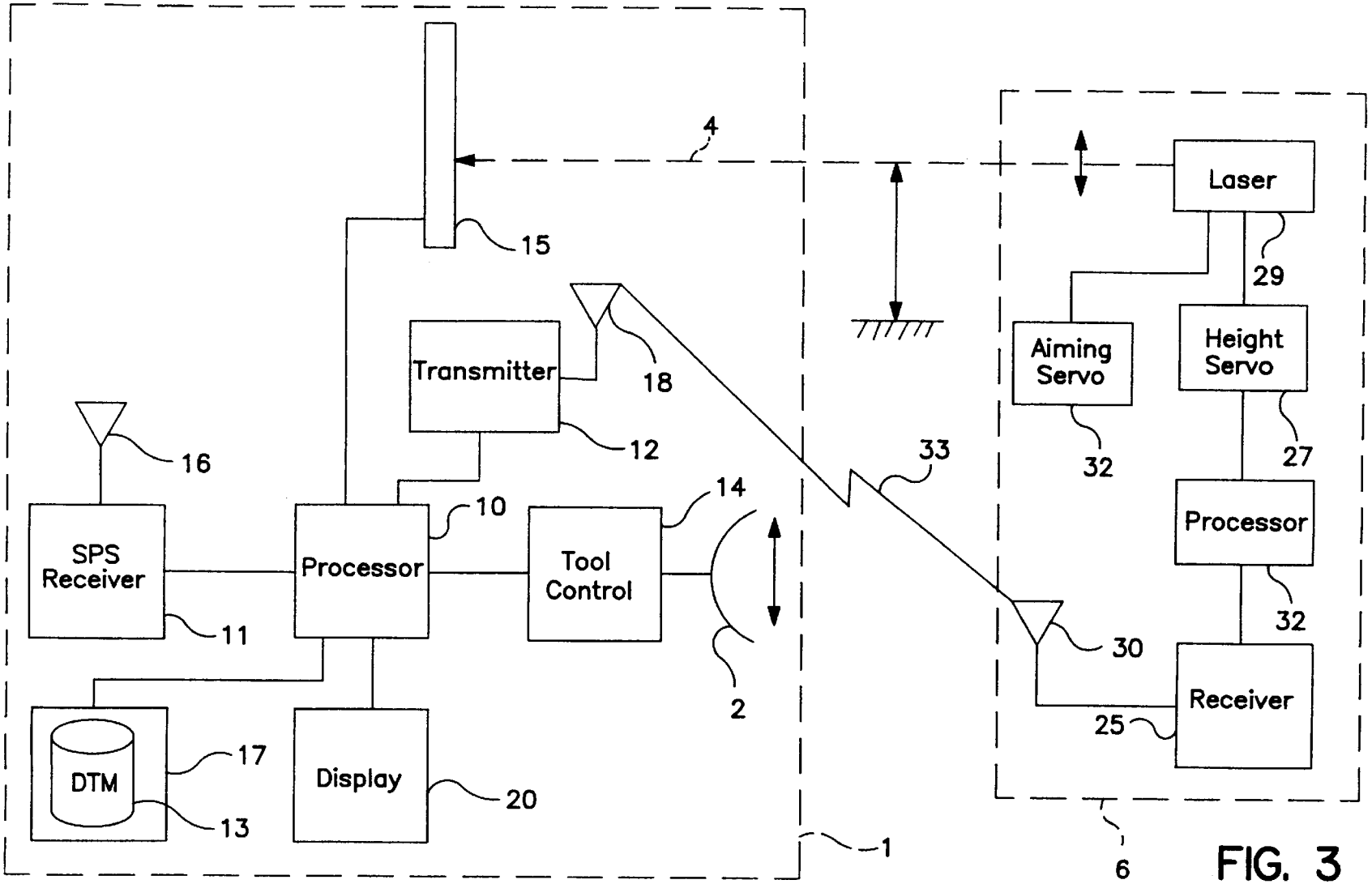
FIG. 3 is a block diagram showing an on-board subsystem in the machine and a stationary subsystem according to an embodiment which uses a scanning laser.

Referring to FIG. 3, in one embodiment which employs a scanning laser, the stationary subsystem 6 includes an aiming servo 32 coupled to the laser 29 for aiming the laser 29. Aiming servo 32 is also coupled to a processor 32, which is also coupled to the receiver 25 and to the height servo 27. Processor 32 may be an appropriately programmed general or special purpose microprocessor, DSP, microcontroller, ASIC, or the like.

Figure 6:
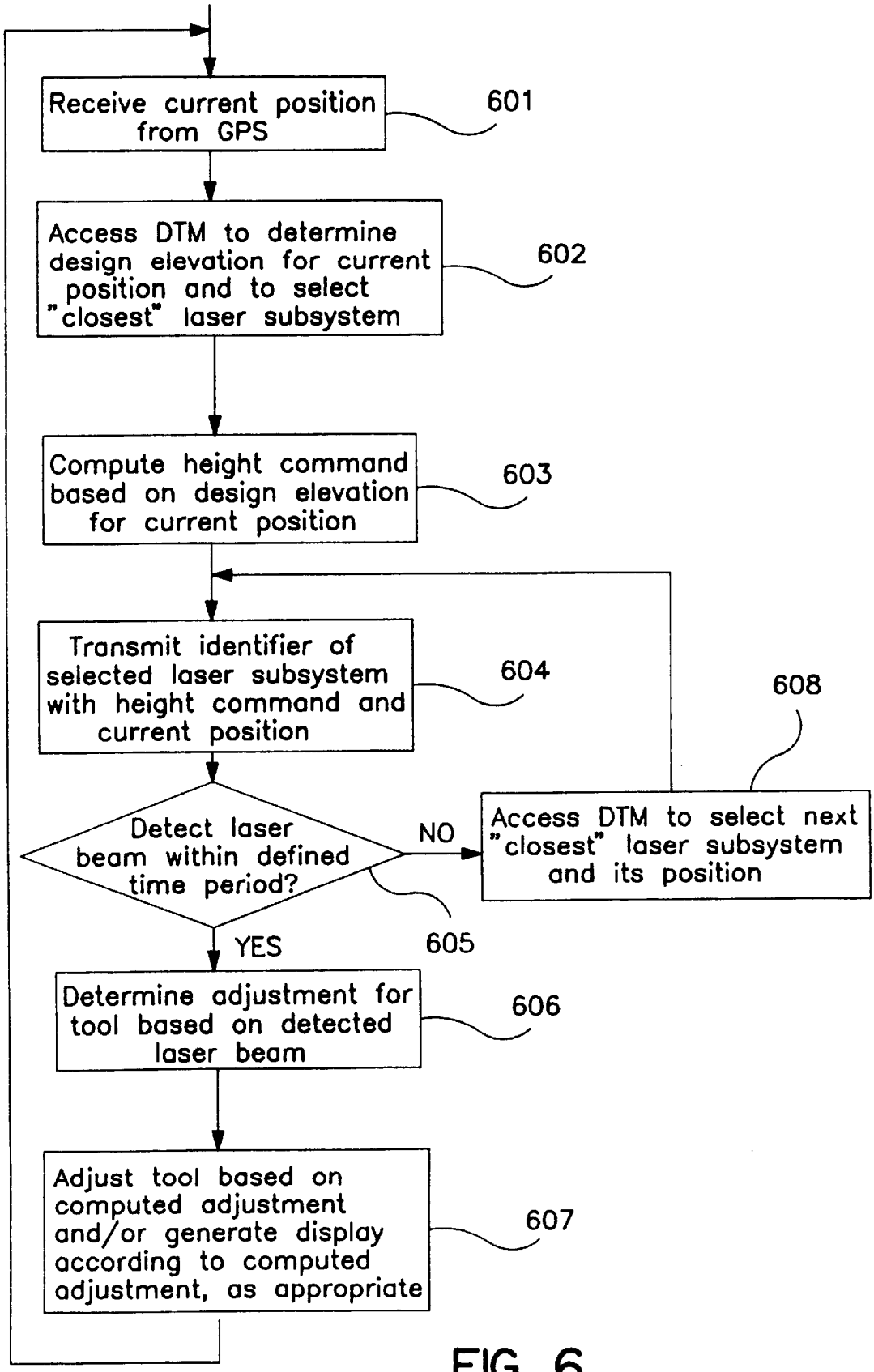
FIG. 6 is a flow diagram illustrating routine performed in the on-board subsystem of FIG. 3.
Figure 7:
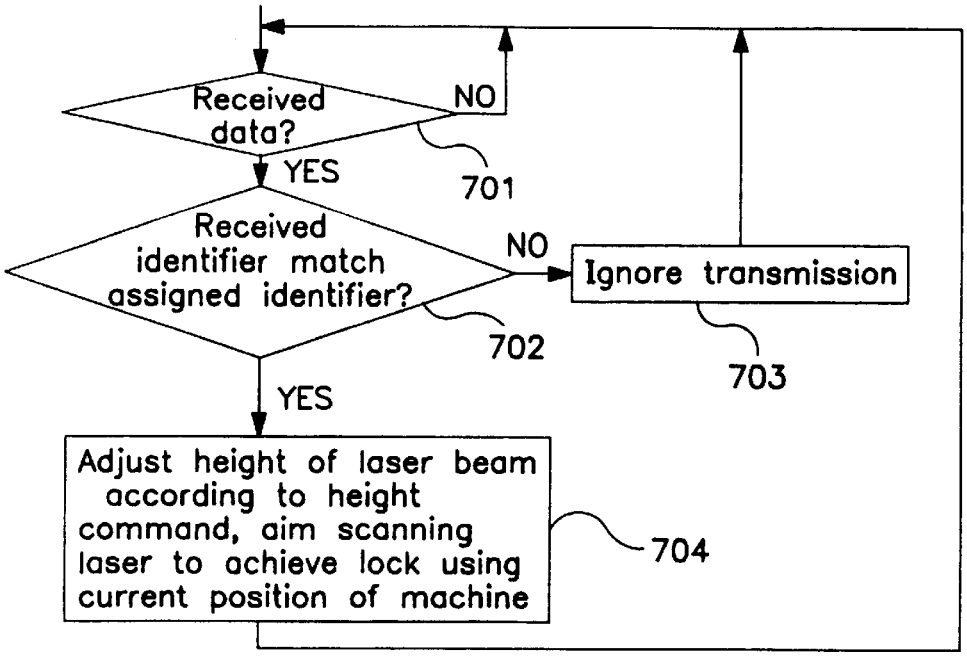
FIG. 7 is a flow diagram illustrating a routine performed in the stationary subsystem of FIG. 3.

Referring now to FIGS. 6 and 7, upon determining the current position of the machine 1 at block 601, the processor 10 of the on-board subsystem accesses the DTM 13 at block 602 to identify the closest stationary subsystem 6 and selects that stationary subsystem. At block 603, the processor 10 computes a height command in the same manner as described above. After selecting the closest stationary subsystem, at block 604 the processor 10 causes transmitter 12 to transmit the height command, the current position coordinates of the machine 1, and the identifier of the selected stationary subsystem 6. Upon receiving the transmitted information at block 701 (FIG. 7), the processor 32 of the stationary subsystem 6 determines at block 702 whether the transmitted identifier matches the identifier assigned to that subsystem. If not, the transmission is ignored at block 703. If the transmitted identifier matches the assigned identifier, then at block 704 the stationary subsystem 6 adjusts the height of the laser beam according to the height command in the transmission, and processor 32 further controls the aiming servo 32 to cause the laser 29 to achieve a lock on the photosensor 15 of the machine 1.

Referring again to FIG. 6, if the laser beam is detected by the on-board subsystem within a predefined period of time at block 605, then at block 606 the processor 10 of the on-board subsystem determines an appropriate adjustment amount for the laser beam based upon the position at which the beam is detected on photosensor 15. At block 607, the position of the tool 2 is adjusted based on the computed adjustment amount, or an appropriate indication is provided to the operator.

At block 605, if the laser beam is not detected within a predefined period of time (e.g., the beam is obstructed or the selected subsystem is malfunctioning), then at block 608 the processor 10 accesses the DTM 13 to identify and select the next closest stationary subsystem 6. The routine then repeats from block 604 using the newly selected subsystem.

Figure 4:
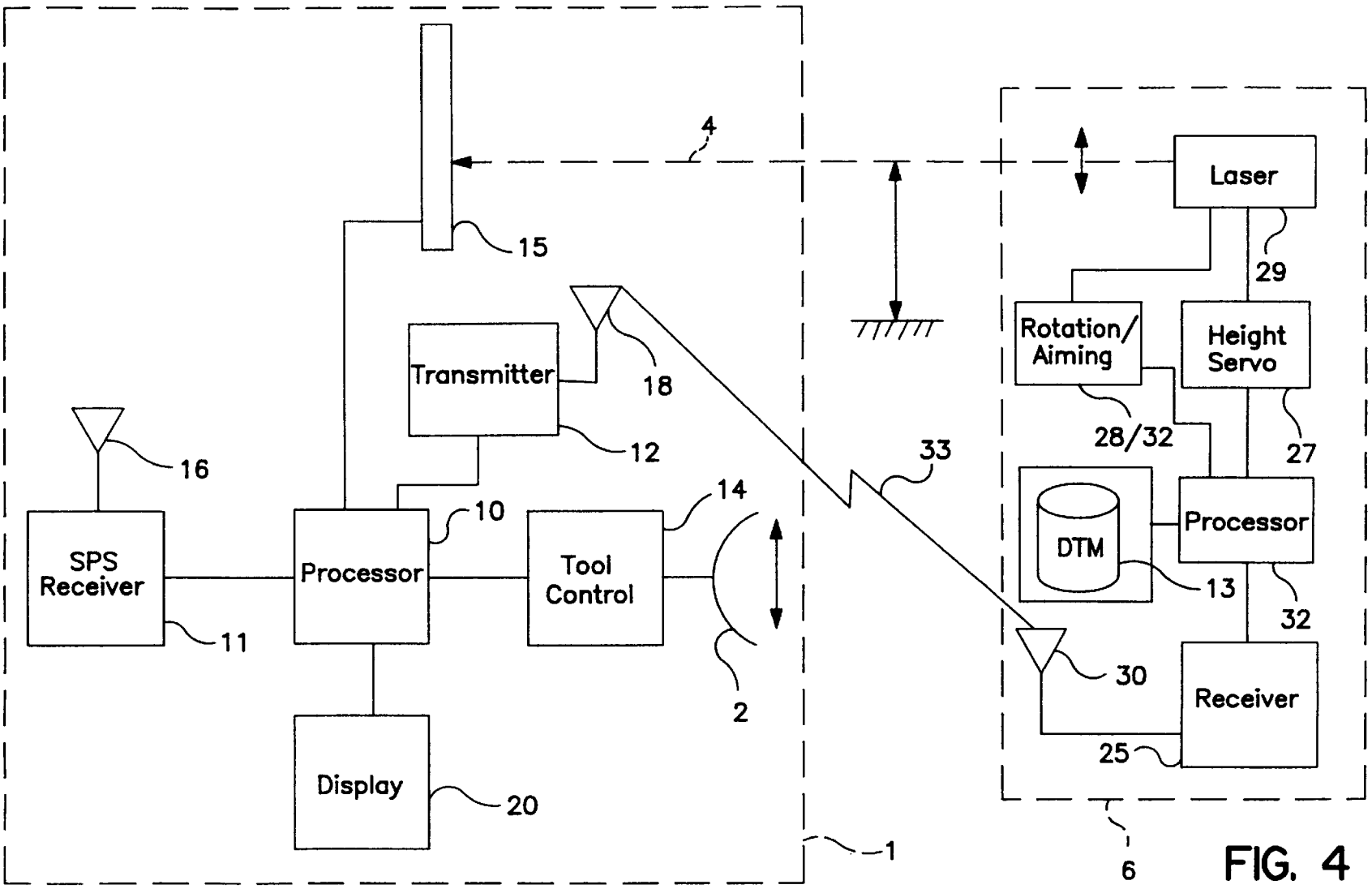
FIG. 4 is a block diagram showing an embodiment in which the digital terrain model (DTM) is maintained within a stationary subsystem.

In certain embodiments, the DTM 13 may be stored off-board, rather than in the on-board subsystem. For example, the DTM 13 may be stored in one or more of the stationary subsystems 6, as shown in FIG. 4, or in a processing device that is physically separate from the stationary subsystems 6. The separate processing device might be, for example, a conventional computer or a GPS base station, which is configured to communicate with the stationary subsystems 6 over a network or other suitable link. Such a link may be a wireless link.

In one embodiment in which the DTM 13 is stored off-board, the on-board subsystem transmits only the current (x,y,z) position coordinates of the machine. The stationary subsystem 6 or other device storing the DTM 13 receives the transmitted coordinates and responds by accessing the DTM 13 to determine the design elevation for the machine's current location and (if appropriate) the stationary subsystem closest to the machine. The closest stationary subsystem is then caused to adjust its laser accordingly.

Figure 8:
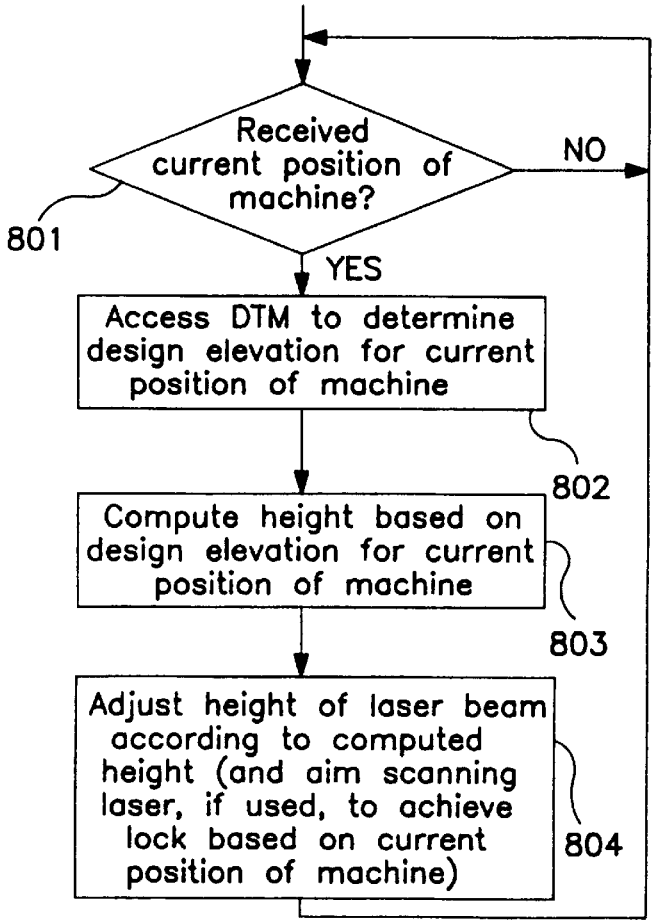
FIG. 8 is a flow diagram illustrating a routine performed in the stationary subsystem of FIG. 4.

FIG. 8 illustrates a routine that may be performed in a stationary subsystem 6 storing the DTM 13. It will be recognized that this routine may be easily adapted, if necessary, to better suit embodiments in which the DTM 13 is stored in a separate processing device. Initially, the on-board subsystem in the machine transmits the current (x,y,z) position coordinates of the machine to the stationary subsystem 6. After such transmission, at block 801, if the stationary subsystem 6 has received the position coordinates of a mobile machine, then at block 802 the stationary subsystem 6 accesses the DTM 13 to determine the design elevation corresponding to the current position of the machine 1. Next, at block 803 the stationary subsystem 6 computes the appropriate height of the laser beam based on the current elevation of the machine 1 and the design elevation for the current (x,y) position of the machine 1. At block 804, the height of the laser beam is adjusted based on the computed height, and if the laser is a scanning laser, it is operated to lock onto the photosensor 15 of the machine 1 using the received position coordinates.

As noted above, the use of multiple stationary subsystems also allows multiple mobile machines to simultaneously position their tools using the techniques described above. Each such machine may equipped with an on-board subsystem as described above. Thus, each machine can use a different stationary subsystem, e.g., the subsystem to which it is closest.

In a multiple-machine, multiple stationary subsystem environment, the DIM 13 may be stored off-board, such as in a stationary subsystem or a separate processing device. In one embodiment, each machine is assigned a unique identifier. The format of such an identifier may be any suitable format, such as described above. From time to time, each machine transmits its identifier along with its position coordinates. The stationary subsystem 6 or other device storing the DTM 13 receives the identifiers and position data from the machines, accesses the DTM 13, and assigns each of the machines to an appropriate stationary subsystem. The assignments may be made based on the relative positions of the machines and the stationary subsystems 6. The stationary subsystem or other device storing the DTM 13 then transmits information to direct each stationary subsystem to adjust its laser accordingly and/or to inform each mobile machine of its assigned stationary subsystem.

Thus, a method and apparatus for accurately positioning a tool on a mobile machine have been described. Although the present invention has been described with reference to specific exemplary embodiments, it will be evident that various modifications and changes may be made to these embodiments without departing from the broader spirit and scope of the invention as set forth in the claims. Accordingly, the specification and drawings are to be regarded in an illustrative sense rather than a restrictive sense.

What is claimed is:

1. A method of enabling accurate positioning of a tool on a mobile unit operating within an area, the method comprising:

storing data representing a specified coordinate for each of a plurality of locations in the area;

determining the current location of the mobile unit;

generating a command based on the current location of the mobile unit and the data;

transmitting the command from the mobile unit to a stationary device, the stationary device operable to generate a beam and responsive to the command by adjusting the beam;

detecting the beam at the mobile unit; and determining an adjustment of the tool at the mobile unit by using the beam as a reference.

2. A method as recited in claim 1, wherein said determining the current location of the mobile unit comprises using a satellite positioning system receiver.

3. A method as recited in claim 1, wherein the beam is a laser beam.

4. A method as recited in claim 1, further comprising transmitting the current location of the mobile unit to the stationary device.

5. A method as recited in claim 1, wherein the command is an elevation command for specifying an elevation of the beam.

6. A method as recited in claim 1, wherein the stationary device is one of a plurality of substantially identical stationary devices, each having a different identifier associated therewith, the method further comprising:

selecting, at the mobile unit, said stationary device from among the plurality of stationary devices based on the current location of the mobile unit; and transmitting the identifier of said stationary device from the mobile unit.

7. A method as recited in claim 1, further comprising transmitting the current location of the mobile unit to the stationary device, the current location for use by the stationary device in generating the beam.

8. A method of accurately positioning a tool on a mobile machine, the method comprising:

storing on-board the machine a terrain model, the terrain model including design elevations for a plurality of locations within a work area;

using a satellite positioning system element on-board the machine to determine the current location of the machine;

accessing the terrain model to determine first data associated with the current location of the machine;

generate second data based on the first data;

transmitting the second data over a wireless link to a stationary reference device;

receiving the second data at the reference device;

generating a laser beam from the reference device based on the second data;

detecting the laser beam on-board the machine; and determining on-board the machine an adjustment of the tool based on detection of the laser beam.

9. A method as recited in claim 8, wherein the first data comprises a design elevation associated with the current location of the machine.

10. A method as recited in claim 9, wherein the second data comprises an elevation command, further comprising adjusting the elevation of the laser beam according to the elevation command.

11. A method as recited in claim 10, further comprising rotating the laser beam to define a horizontal reference plane defined at an elevation based on the elevation command.

12. A method as recited in claim 10, further comprising determining the elevation command based on a design elevation from the terrain model, the design elevation corresponding to the current location of the machine.

13. A method as recited in claim 8, further comprising:

maintaining a plurality of reference devices substantially identical to said reference device, each at a different location about the work area;

storing the locations of each of the reference devices on-board the machine, and wherein the first data comprises the identity of one of the reference devices.

14. A method as recited in claim 8, wherein the second data comprises:

an identifier corresponding td a closest available one of the reference devices to the machine; and the current location of the machine.

15. A method as recited in claim 14, wherein the laser comprises a scanning laser, the method further comprising responding to the second data to aim the scanning laser.

16. A method as recited in claim 8, further comprising outputting an indication of the adjustment to an operator of the tool to guide the operator in positioning the tool.

17. A method as recited in claim 8, further comprising automatically positioning the tool based on the adjustment.

18. A method as recited in claim 8, further comprising:

outputting an indication of the adjustment to an operator of the tool to guide the operator in positioning the tool when the on-board subsystem is in a guidance mode;

automatically positioning the tool based on the adjustment when the on-board subsystem is in an automatic mode; and automatically switching the on-board subsystem from the guidance mode to the automatic mode in response to detecting a defined condition.

19. A method as recited in claim 18, wherein said detecting the defined condition comprises detecting a defined difference between a design elevation and an actual elevation, for the current location of the machine.

20. An on-board subsystem in a mobile machine operating in a work area and having a positionable tool, the on-board subsystem for enabling accurate positioning of the tool and comprising:

a storage device storing data representing specified positions for a plurality of locations in the work area;

a positioning system element configured to precisely determine the current location of the mobile machine;

a transmitter configured to transmit data including an elevation command to a stationary device generating a laser beam, the elevation command for use by the stationary device in adjusting an elevation of the laser beam;

a sensor configured to detect the elevation of the laser beam; and a control circuit configured to generate the elevation command based on the current location and the data representing the specified elevations, and to determine an adjustment of the tool based on an output of the sensor.

21. An on-board subsystem as recited in claim 20, wherein the positioning system element comprises a satellite positioning system receiver.

22. An on-board subsystem as recited in claim 20, further comprising an indicator configured to receive data representing the adjustment from the control circuit and to output an indication of the adjustment to an operator of the tool to guide the operator in positioning the tool.

23. An on-board subsystem as recited in claim 20, wherein the control circuit is further configured to cause the position of the tool to be automatically adjusted based on the adjustment.

24. An on-board subsystem as recited in claim 20, further comprising:

an indicator configured to output an indication of the adjustment to an operator of the tool to guide the operator in positioning the tool, when the on-board subsystem is in a guidance mode;

an adjustment mechanism configured to automatically position the tool based on the adjustment, when the on-board subsystem is in an automatic mode; and means for automatically switching the on-board subsystem from the guidance mode to the automatic mode in response to detecting a defined condition.

25. An on-board subsystem as recited in claim 24, wherein the defined condition comprises detecting a defined difference between a specified elevation and an actual elevation, for the current location of the mobile machine.

26. An on-board subsystem as recited in claim 20, wherein the data transmitted to the stationary device further comprises the current location of the mobile machine.

27. An on-board subsystem as recited in claim 20, further comprising a control circuit configured to:

determine one of the specified elevations associated with the current location of the mobile machine; and generate the elevation command based on said one of the specified elevations.

28. An on-board subsystem as recited in claim 20, wherein the stationary device is one of a plurality of substantially identical stationary devices, each having a different identifier associated therewith, wherein the control circuit is further configured to select said stationary device from among the plurality of stationary devices based on the current location of the mobile machine and to determine the identifier of the selected stationary device, wherein the transmitted data further includes the identifier.

29. An on-board subsystem as recited in claim 20, wherein the data transmitted to the stationary device further includes the current location of the mobile machine, and the stationary device includes:

a receiver for receiving the data from the mobile machine, including the current position of the mobile machine; and a scanning laser configured to direct the laser beam toward the mobile machine based on the current position of the mobile machine.

30. A system for enabling accurate positioning of a tool in a mobile unit operating in a work area, the system comprising:

a stationary reference device;

means for storing on-board the machine a digital terrain model (DTM), the DTM including design elevations for a plurality of locations within the work area;

means on-board the machine for determining the current location of the machine;

means for accessing the DTM to determine first data associated with the current location of the machine;

means for generating second data based on the first data;

means for transmitting the second data over a wireless link to the stationary reference device;

means for receiving the second data at the stationary reference device;

means for generating a laser beam from the stationary reference device based on the second data;

means for detecting the laser beam on-board the machine; and means for determining on-board the machine an adjustment of the tool based on detection of the laser beam.

31. A system as recited in claim 30, wherein the first data comprises a design elevation associated with the current location of the machine.

32. A system as recited in claim 31, wherein the second data comprises an elevation command, further comprising adjusting the elevation of the laser beam according to the elevation command.

33. A system as recited in claim 32, further comprising means for rotating the laser beam to define a horizontal reference plane at an elevation based on the elevation command.

34. A system as recited in claim 32, further comprising means for determining the elevation command based on a design elevation from the DTM corresponding to the current location of the machine.

35. A system as recited in claim 30, further comprising:

a plurality of stationary reference devices substantially identical to said stationary reference device, each at a different location about the work area;

means for storing the locations of each of the stationary reference devices onboard the machine, wherein the first data comprises the identity of one of the stationary reference devices.

36. A system as recited in claim 35, wherein the second data comprises:

an identifier corresponding to a closest available one of the stationary reference devices to the machine; and the current location of the machine.

37. An on-board subsystem in a mobile machine having a positionable tool and operating in a work area, the system for enabling accurate positioning of the tool and comprising:

a storage device having a digital terrain model (DTM) stored therein, the DTM including specified elevations for a plurality of locations within the work area;

a satellite positioning system element configured to determine the current location of the machine;

a first control circuit configured to:

access the DTM to determine first data associated with the current location of the machine; and generate second data based on the first data;

a transmitter configured to transmit the second data to a stationary subsystem comprising a stationary device, the stationary device including:

a laser for generating a laser beam;

a receiver configured to receive the second data;

a mechanism configured to vary a direction of the laser beam; and a second control circuit configured to control the mechanism in response to the second data;

the on-board subsystem further comprising:

a sensor configured to detect the laser beam; and a third control circuit configured to determine an adjustment of the tool based on an output of the sensor.

38. An on-board subsystem as recited in claim 37, wherein the first data comprises a specified elevation associated with the current location of the machine.

39. An on-board subsystem as recited in claim 38, wherein the second data comprises an elevation command, the servo mechanism is configured to adjust the elevation of the laser beam, and the second control circuit is configured to control the servo mechanism in response to the elevation command to adjust the elevation f the laser beam.

40. An on-board subsystem as recited in claim 39, wherein the elevation command is determined based on a specified elevation from the DTM, corresponding to the current location of the machine.

41. An on-board subsystem as recited in claim 39, wherein the stationary device further comprises a rotation mechanism configured to rotate the laser beam to define a horizontal reference plane.

42. An on-board subsystem as recited in claim 37, wherein the stationary subsystem includes a plurality of stationary devices substantially identical to said stationary device, each located at a different location about the work area, wherein the storage device further has stored therein the locations of each of the stationary devices, and wherein the first data comprises the identity of one of the stationary devices.

43. An on-board subsystem as recited in claim 42, wherein the second data comprises:

an identifier corresponding to a closest available one of the stationary devices to the machine; and the current location of the machine.

44. An on-board subsystem as recited in claim 43, wherein the laser comprises a scanning laser, and wherein the second control circuit is configured to control the mechanism in response to the second data to aim the laser.

45. An on-board subsystem as recited in claim 37, further comprising an indicator configured to output an indication of the adjustment to an operator of the tool to guide the operator in positioning the tool.

46. An on-board subsystem as recited in claim 37, further comprising an adjustment mechanism configured to automatically position the tool based on the adjustment.

47. An on-board subsystem as recited in claim 37, further comprising:

an indicator configured to output an indication of the adjustment to an operator of the tool to guide the operator in positioning the tool, when the on-board subsystem is in a guidance mode;

an adjustment mechanism configured to automatically position the tool based on the adjustment, when the on-board subsystem is in an automatic mode; and means for automatically switching the on-board subsystem from the guidance mode to the automatic mode in response to detecting a predefined condition.

48. A system for enabling accurate positioning of a tool on a mobile machine operating in a work area, the system comprising:

a stationary subsystem including:

a laser for generating a laser beam;

a rotation mechanism configured to rotate the laser beam to provide a horizontal reference plane;

a receiver configured to receive data from the mobile machine over a wireless link, the data including an elevation command;

a servo mechanism configured to adjust the elevation of the laser beam; and a first control circuit configured to control the servo mechanism to adjust the elevation of the laser beam based on the elevation command; and an-board system in the mobile machine, the on-board subsystem including:

a storage device having a digital terrain model (DTM) stored therein, the DTM including design elevations for a plurality of locations within the work area;

a satellite positioning system receiver configured to determine the current location of the machine;

a second control circuit configured to:

access the DTM to identify a design elevation corresponding to the current location of the machine; and generate the elevation command based on said design elevation;

a transmitter configured to transmit the elevation command to the receiver of the stationary subsystem;

a sensor configured to detect the rotating laser beam; and a third control circuit configured to determine an adjustment of the tool based on an output of the sensor.

49. A system for enabling accurate positioning of a tool on a mobile machine operating in a work area, the system comprising:

a plurality of stationary subsystems positioned about the work area, each stationary subsystem including:

a laser for generating a laser beam;

a servo mechanism configured to aim the laser beam;

a receiver configured to receive from the machine an identifier and a current location of the machine over a wireless link; and a first processor configured detect when the received identifier corresponds to an identifier assigned to said stationary subsystem and, in response to such detection, to control the servo mechanism to aim the laser beam toward the mobile machine; and an on-board system in the mobile machine, the on-board subsystem including:

a storage device having a digital terrain model (DTM) stored therein, the DTM indicating the locations of each of the stationary subsystems;

a satellite positioning system element configured to determine the current location of the machine;

a second control circuit configured to:

select one of the stationary subsystems based on the current location of the machine and the DTM; and determine the identifier of the selected one of the stationary subsystems;

a transmitter configured to transmit the current location of the machine and the identifier of the selected one of the stationary subsystems so as to be receivable by the receiver;

a sensor configured to detect the laser beam when the laser beam is aimed at the sensor; and a third control circuit configured to determine an adjustment of the tool based on an output of the sensor.

50. A method of enabling accurate positioning of a tool on a remote mobile machine operating in a work area, the method comprising:

generating a laser beam to define a reference coordinate for use in positioning the tool;

receiving from the machine first data indicating the current location of the machine;

maintaining second data representing specified coordinates for a plurality of locations within the work area; and accessing the second data to determine a specified coordinate corresponding to the current location of the machine; and adjusting a coordinate of the laser beam based on said specified coordinate to adjust the reference coordinate.

51. A method as recited in claim 50, wherein the laser comprises a scanning laser, the system further comprising means for aiming the laser at a target based on the first data.

52. A method as recited in claim 50, further comprising a rotation mechanism for rotating the laser at the reference coordinate.

53. A method as recited in claim 50, wherein said maintaining the second data comprises maintaining the second data local to the laser.

54. A reference system for enabling accurate positioning of a tool on a mobile machine operating in a work area, the reference system comprising:

a laser configured to generate a laser beam to define a reference level for use in positioning the tool;

a receiver configured to receive first data from a remote source;

an adjustment mechanism configured to adjust the elevation of the laser to vary the reference level;

a storage device having a terrain model stored therein, the terrain model including specified elevations for a plurality of locations within the work area; and a control circuit configured to access the terrain model to determine a specified elevation corresponding to the first data and to control the adjustment mechanism based on said specified elevation to adjust the reference level.

55. A reference system as recited in claim 54, wherein the laser comprises a scanning laser, the system further comprising means for aiming the laser at a target based on the first data.

56. A reference system as recited in claim 54, further comprising a rotation mechanism for rotating the laser at the reference level.

57. A reference system as recited in claim 56, wherein the mobile machine includes the remote source, and wherein the first data indicates a current location of the machine.

58. A method of enabling accurate positioning of a tool in a mobile unit, the method comprising:

operating an on-board subsystem in the mobile unit in a guidance only mode, including:

operating the on-board subsystem to automatically compute a first adjustment of the tool; and outputting an indication of the first adjustment to an operator to guide the operator in manually positioning the tool;

operating the on-board subsystem in an automatic mode, including:

operating the on-board subsystem to automatically compute a second adjustment of the tool; and operating the on-board subsystem to automatically position the tool based on the second adjustment; and automatically switching the on-board subsystem between the guidance only mode and the automatic mode in response to detecting a predefined condition.

59. A method as recited in claim 58, wherein the predefined condition comprises detection of a predefined difference between a specified elevation and an actual elevation associated with a current location of the mobile unit.

60. A method as recited in claim 59, further comprising:

storing in the on-board subsystem a terrain mode including a plurality of specified elevations, including said specified elevation;

using a positioning system in the on-board subsystem to determine the current location of the mobile unit; and accessing the terrain model to determine said specified elevation associated with the current location of the mobile unit.

61. An on-board subsystem in a mobile unit operating in a work area and having a positionable tool, the on-board subsystem for enabling accurate positioning of the tool, the on-board subsystem capable of operating in both an automatic mode and a guidance only mode, the on-board subsystem comprising:

a control circuit configured to determine an adjustment of the tool;

an indicator configured to output an indication of the adjustment to an operator to guide the operator in positioning the tool when the on-board subsystem is in the guidance only mode;

means for automatically positioning the tool based on the adjustment when the on-board subsystem is in the automatic mode; and means for automatically switching the on-board subsystem from the guidance only mode to the automatic mode in response to detecting a predefined condition.

62. An on-board subsystem as recited in claim 61, wherein the predefined condition comprises the occurrence of a predefined difference between a specified elevation and an actual elevation associated with a current location of the mobile unit.

63. An on-board subsystem as recited in claim 61, comprising:

means for storing a terrain model including a plurality of specified elevations;

a positioning system for determining determine the current location of the mobile unit; and means for accessing the terrain model to determine a specified elevation associated with the current location of the mobile unit;

wherein the predefined condition is based on said specified elevation.

64. A method of positioning a tool on a mobile unit, the method comprising:

using a positioning system on-board the mobile unit to determine the location of the mobile unit;

selecting one of a plurality of selectable stationary reference devices; and using the selected one of the plurality of selectable stationary reference devices and the location of the mobile unit to determine a positional adjustment for the tool.

65. A method as recited in claim 64, wherein said using a positioning system comprises using a satellite positioning system receiver.

66. A method as recited in claim 64, wherein said using one of a plurality of selectable stationary reference devices comprises using a laser beam generated by said one of the plurality of selectable stationary reference devices, wherein each of the plurality of selectable stationary reference devices is equipped to generate a laser beam.

67. A method as recited in claim 64, further comprising storing data on the locations of each of the plurality of selectable reference devices on-board the mobile unit, the method further comprising using the data on the locations of each of the plurality of selectable reference devices and the location of the mobile unit to select said one of the plurality of selectable reference devices.

68. A method as recited in claim 64, further comprising storing a digital terrain model on-board the mobile unit;

wherein said using one of the plurality of selectable stationary reference devices comprises using the digital terrain model and the location of the mobile unit to determine the positional adjustment for the tool.

69. A method as recited in claim 64, further comprising:

storing a digital terrain model on-board the mobile unit;

storing data on the locations of each of the plurality of selectable reference devices on-board the mobile unit; and using the data on the locations of each of the plurality of selectable reference devices and the location of the mobile unit to select said one of the plurality of selectable reference devices;

wherein said using one of the plurality of selectable stationary reference devices comprises using the digital terrain model and the location of the mobile unit to determine the positional adjustment for the tool.

* * * * *